US008256631B2

(12) United States Patent
Hoffmann et al.

(10) Patent No.: US 8,256,631 B2
(45) Date of Patent: Sep. 4, 2012

(54) CLOSURE SYSTEM FOR CONTAINERS

(75) Inventors: Hans-Rainer Hoffmann, Neuwied (DE); Rudolf Matusch, Marburg (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 565 days.

(21) Appl. No.: 12/283,231

(22) Filed: Sep. 10, 2008

(65) Prior Publication Data

US 2009/0159553 A1 Jun. 25, 2009

Related U.S. Application Data

(63) Continuation-in-part of application No. PCT/EP2007/007211, filed on Aug. 16, 2007.

(30) Foreign Application Priority Data

Aug. 31, 2006 (DE) ..... 10 2006 040 888

(51) Int. Cl.
*B65D 39/02* (2006.01)
*B65D 41/00* (2006.01)

(52) U.S. Cl. ..... 215/251; 220/359.1

(58) Field of Classification Search ..... D9/436, D9/435; 215/200, 251, 250, 232, 341, 316; 220/359.1, 254.1, 255.1, 255, 258.1, 258.3, 220/258.5, 256.1, FOR. 206, FOR. 203, FOR. 186; *B65D 39/02, 41/62, 41/00*

See application file for complete search history.

(56) References Cited

U.S. PATENT DOCUMENTS 3,001,658 A 9/1961 Herter
3,690,499 A * 9/1972 Westfall et al. ..... 215/253
3,792,794 A * 2/1974 Cutter et al. ..... 215/247
3,913,771 A * 10/1975 Acton et al. ..... 215/256
3,944,102 A * 3/1976 Grau ..... 215/251
4,105,133 A * 8/1978 La Barge et al. ..... 220/266
4,109,815 A * 8/1978 Collins, III ..... 215/232

(Continued)

FOREIGN PATENT DOCUMENTS

DE 90 11 309 U1 10/1990

(Continued)

OTHER PUBLICATIONS

DIN ISO 11 040 Part 3, Nov. 1993, "Prefilled syringes; Aluminum caps for dental local anaesthetic cartridges", no translation.

*Primary Examiner* — Mickey Yu
*Assistant Examiner* — Robert J Hicks
(74) *Attorney, Agent, or Firm* — R. S. Lombard; K. Bach

(57) ABSTRACT

A closure system is provided for containers used for storing or administering substances in the form of liquids, pastes or powders, which includes a cap, provided with a through-hole, and a closure element, wherein the cap holds the closure element with a force fit and/or form fit on the container, in the area of the container opening that is to be closed, by a catch element present on the container. The end face which surrounds the container opening, and on which the closure element bears, comprises a depression. The closure element is a virus-proof, bacteria-proof and spore-proof film that lies on the end face and, at least in some areas, over the depression. The cap is then fitted in place, an elastomer ring or adhesive ring is arranged between the closure element and the depression and fills the depression.

7 Claims, 6 Drawing Sheets

U.S. PATENT DOCUMENTS 4,181,232 A * 1/1980 Bellamy et al. ..... 215/232
4,378,892 A * 4/1983 Ochs et al. ..... 215/232
4,813,561 A * 3/1989 Ochs ..... 215/252
4,880,127 A * 11/1989 Doi ..... 215/252
5,031,787 A * 7/1991 Ochs ..... 215/276
5,984,124 A * 11/1999 Takano ..... 215/252
5,988,414 A * 11/1999 Schwarz et al. ..... 215/261

FOREIGN PATENT DOCUMENTS

DE 102006040888 B3 * 11/2007
FR 2 373 454 A 7/1978

* cited by examiner

Fig. 5
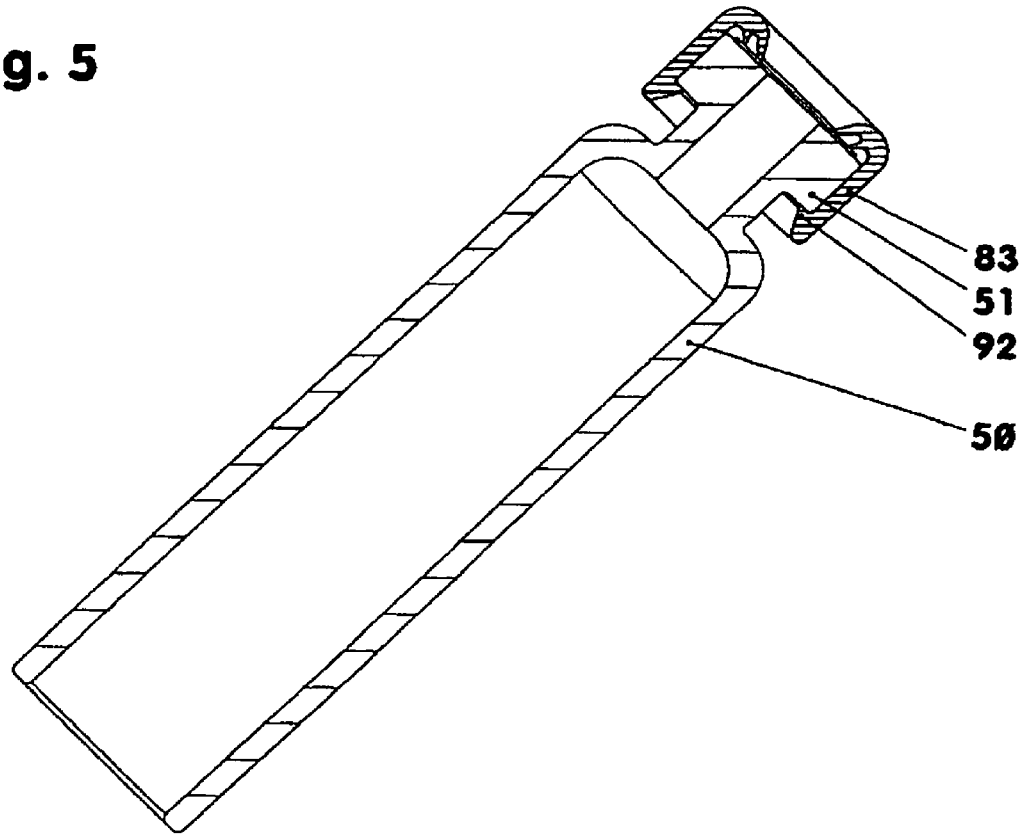
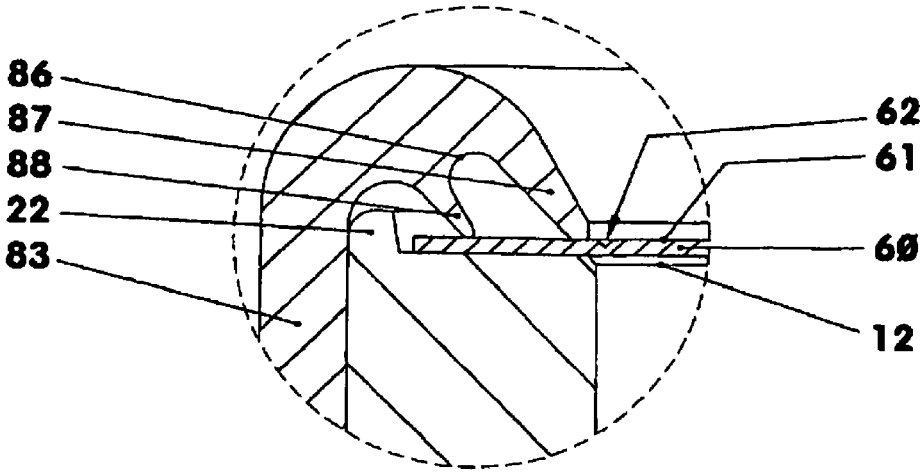
Fig. 7

Fig. 6
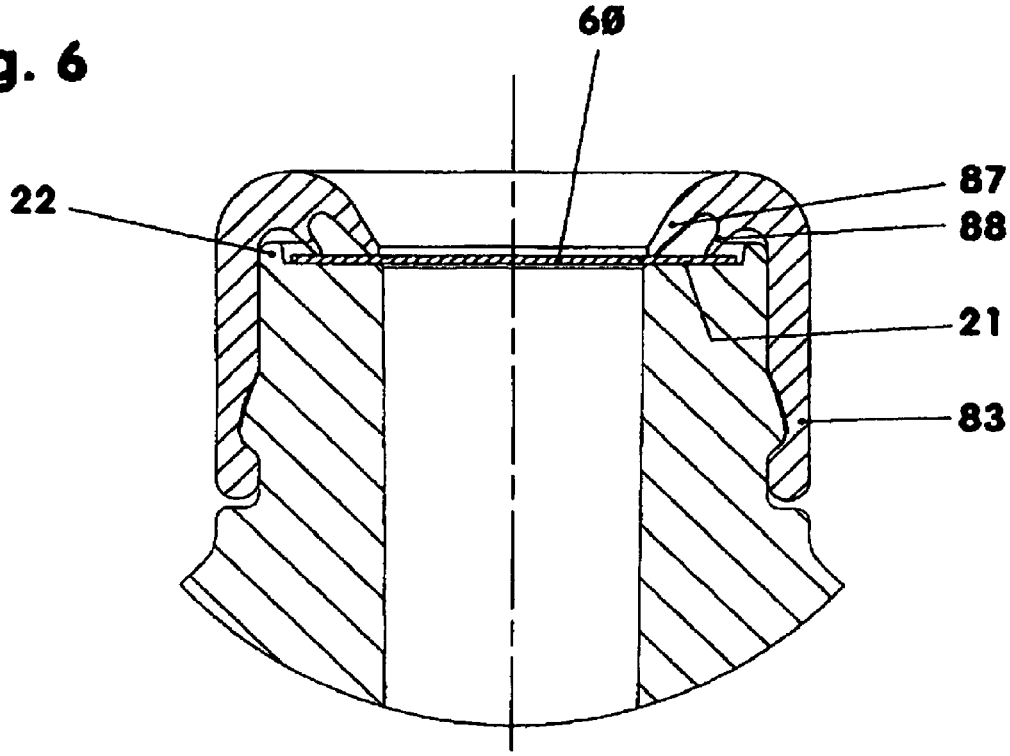
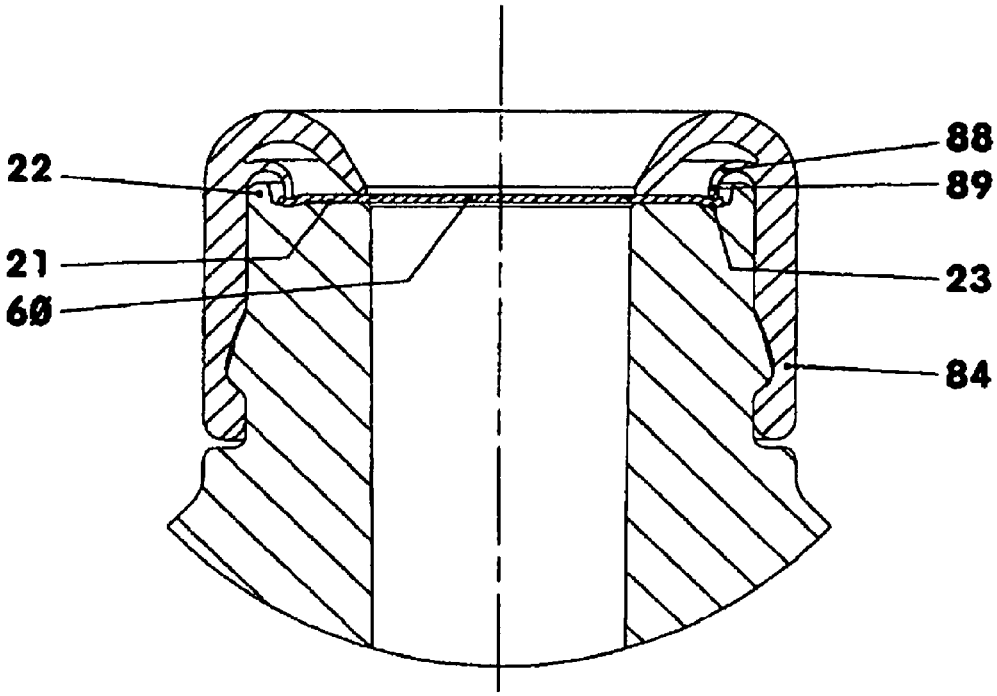
Fig. 8

Fig. 9
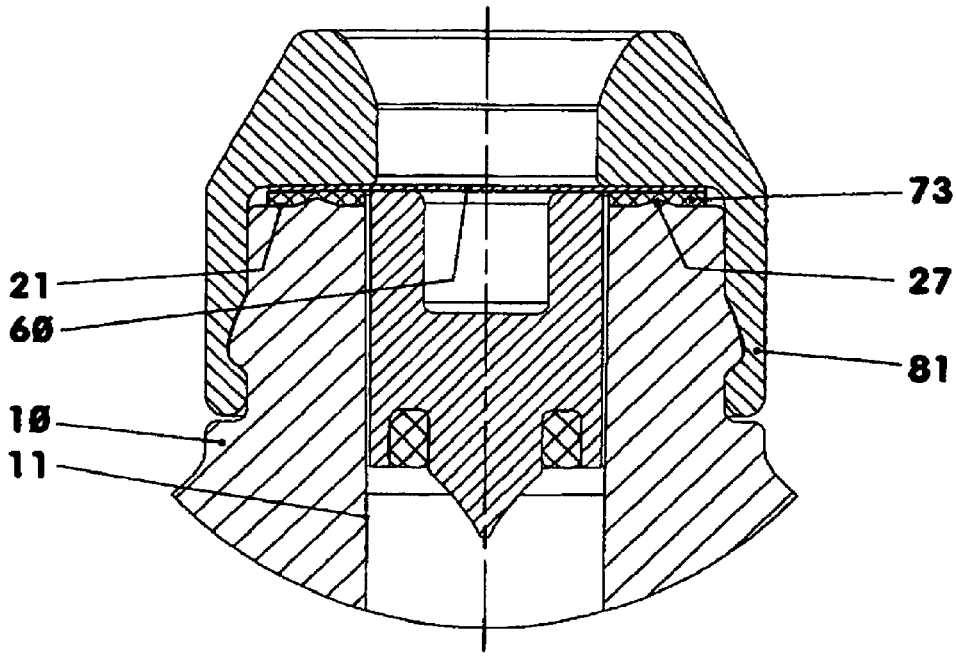
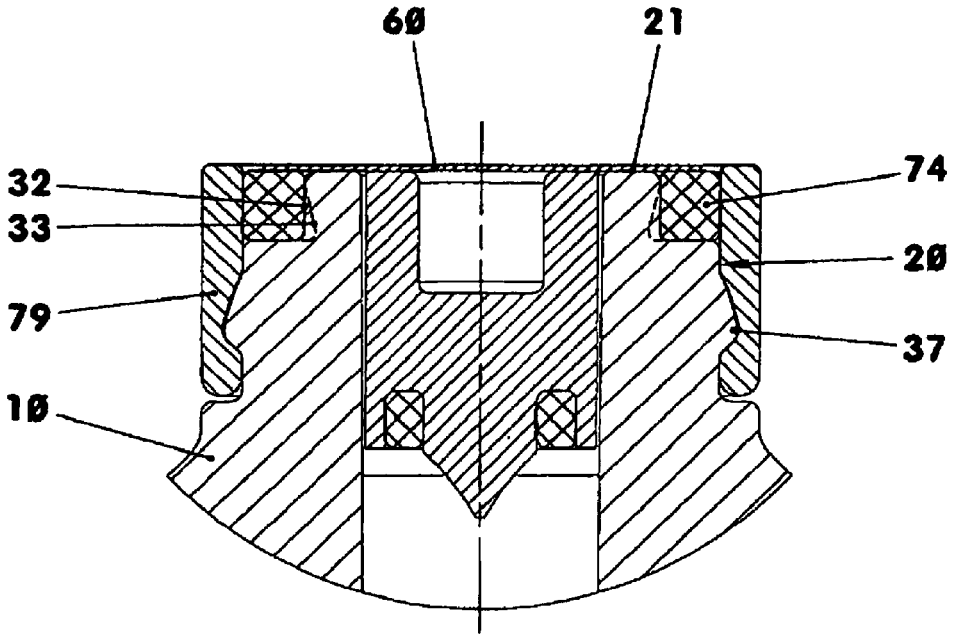
Fig. 10

CLOSURE SYSTEM FOR CONTAINERS

CROSS-REFERENCE TO RELATED APPLICATION

This is a continuation-in-part application of pending international application PCT/EP2007/007211 filed Aug. 16, 2007 and claiming the priority of German Application No. 10 2006 040 888.8 filed Aug. 31, 2006.

BACKGROUND OF THE INVENTION

The invention relates to a closure system for containers used for storing or administering substances in the form of liquids, pastes or powders, which system is composed of a cap, provided with a through-hole, and of a closure element, said cap holding the closure element with a force fit and/or form fit on the container, in the area of the opening that is to be closed, by means of an undercut present on the container.

Aluminum caps for dental vials are known from DIN ISO 11 040 part 3 of year 1993. These caps are used to securely close glass cylinders, for example, by means of piston plugs or sealing discs. For this purpose, after the piston plugs or sealing discs have been applied, the caps are fixed on the glass cylinder by means of a deformation process carried out on the cap. Part 2 of the standard describes, among other things, thin sealing discs made of an elastomeric material.

SUMMARY OF THE INVENTION

The present invention provides a closure system for containers used for storing or administering substances in the form of liquids, pastes or powders, which system in one embodiment includes a cap, provided with a through-hole, and a closure element, wherein the cap holds the closure element with a force fit and/or form fit on the container, in the area of the container opening that is to be closed, by means of a catch element present on the container. For this purpose, the end face which surrounds the container opening, and on which the closure element bears, comprises a depression. The closure element is a virus-proof, bacteria-proof and spore-proof film that lies on the end face and, at least in some areas, over the depression. The cap is then fitted in place, an elastomer ring or adhesive ring is arranged between the closure element and the depression and fills the depression. With the present invention, a closure system for containers is provided that allows the container to be securely closed permanently and in a virus-proof, bacteria-proof and spore-proof manner.

The invention provides a closure system for containers which, without application of thermal energy, and in a mechanically simple way, allows the container to be securely closed permanently in a virus-proof, bacteria-proof and spore-proof manner.

In one of the preferred embodiments of the present invention, the end face which surrounds the container opening, and on which the closure element bears, comprises a depression. The closure element is a virus-proof, bacteria-proof and spore-proof film that lies on the end face and, at least in some areas, over the depression. When the cap is fitted in place, an elastomer ring or adhesive ring is arranged between the closure element and the depression and fills the depression.

In another embodiment of the invention, the closure element bears on an end face provided with an elevation. In this case, an elastomer ring is arranged on the closure element, and the elevation presses into this elastomer ring when the cap is fitted in place.

In yet another embodiment of the invention, a closure system is provided in which the cap, on its inner face directed towards the closure element, has at least one closed, elastic sealing lip that bears resiliently on the closure element.

In yet still another embodiment of the present invention, a closure system is provided without a cap. In this case, the elastomer ring, connected fixedly to the closure element, is clamped radially on a radial outer contour of the container, for example situated in the area of the opening that is to be closed.

The invention provides a closure system for containers which is easy and safe to handle and with which substances in the form of liquids, pastes or powders, in particular medicaments, for example pharmaceutical liquids containing proteins, are permanently enclosed in a sealed manner in a container.

BRIEF DESCRIPTION OF THE DRAWINGS

Further details of the invention will become clear from the following illustrative embodiments which are depicted schematically in the Figures, in which:

FIG. 5 shows an elevation cross-sectional schematic view of a carpule with cap and sealing film;

FIG. 6 shows an elevation cross-sectional schematic view of the upper portion of a medicament chamber with a cap that is elastic in relation to the sealing film;

FIG. 7 shows a detail from FIG. 6;

FIG. 8 shows the same view as in FIG. 6, but with at least one other film contact element;

FIG. 9 shows the same view as in FIG. 4, but with an edge elevation and a flat elastomer ring;

FIG. 10 shows an elevation cross-sectional schematic view of the upper portion of a medicament chamber with clamping ring; and, FIG. 11 shows an elevation cross-sectional schematic view of the upper portion of a medicament chamber without clamping ring and without cap.

DETAILED DESCRIPTION OF THE PREFERRED EMBODIMENTS

Figure 1:
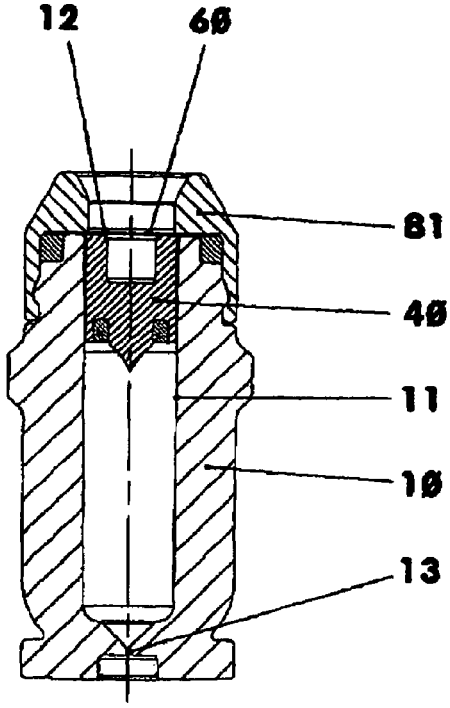
FIG. 1 is an elevation cross-sectional schematic view of a medicament chamber with cap and sealing film.

FIG. 1 shows a container (10) with a piston (40) and a closure system. The container (10) is designated hereinafter as a medicament chamber.

The medicament chamber (10) is, in combination with the piston (40), an assembly group of an injection system. The medicament to be administered is initially stored, for example in liquid form, in the medicament chamber (10). For this purpose, the medicament has to be enclosed in the cylinder (11) of the chamber (10) in a virus-proof, bacteria-proof and spore-proof manner. The for example conical cylinder (11) has two openings (12, 13). A front opening (13) is the outlet nozzle. A rear opening (12) is used, inter alia, for filling the cylinder (11). When the chamber (10) is filled, the piston (40) is positioned in the rear area of the cylinder (11). Situated directly behind the piston (40), there is a cap (81) which, with the aid of a closure element (60), closes the rear opening (12) in a virus-proof, bacteria-proof and spore-proof manner. Of course, the container (10) can also be provided with just one opening (12), namely the opening (12) that is closed by the proposed closure system. If appropriate, the closure system can also be gas-tight.

Figure 2:
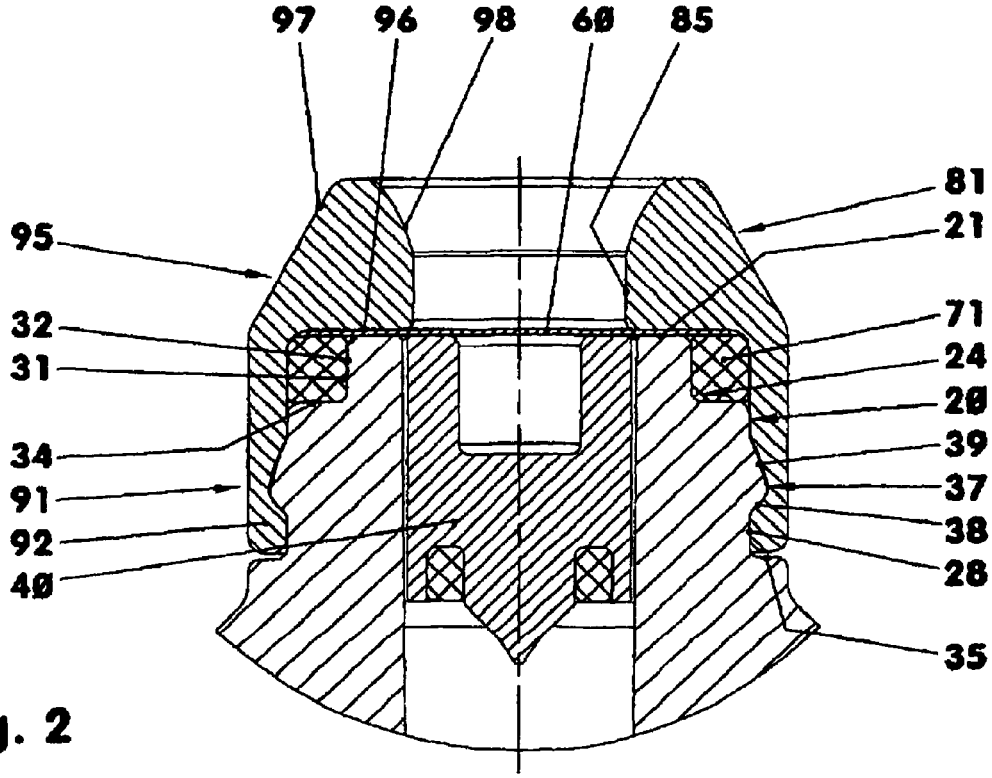
FIG. 2 shows an enlarged partial cross section from FIG. 1.

For fixing the elastic cap (81), the rear area of the chamber (10), made from cyclo-olefin-copolymer (COC) plastic for example, has a defined contour (see FIG. 2). The chamber (10) has a roughly cylindrical tube-shaped endpiece (20) with an end face (21), which is plane for example, and with a cylindrical outer contour (28). At the front, the endpiece (20) ends in a housing collar (35).

A further housing collar (31) is situated in the transition area between the end face (21) and the cylindrical outer contour (28). The width of this housing collar (31) is, for example, 50% of the wall thickness of the endpiece (20). The depth of this housing collar (31) is slightly greater than its width. The radial flank (32) of the housing collar (31) is cylindrical, while the axial flank (34) is flat.

Situated below the housing collar (31), there is a circumferential catch elevation (37), for example with two flanks. Its length corresponds to approximately 50% of the endpiece (20) length and is located between the two housing collars (31, 35). In this illustrative embodiment, the circumferential catch elevation (37), which is situated centrally there for example, is without interruption. The catch elevation (37) has a front flank (38) and a rear flank (39). The rear flank angle is, for example, 17±3 angular degrees, while the front flank angle is, for example, 51±3 angular degrees. The catch elevation (37) is rounded in the area of the zone of contact of the two flanks (38, 39).

According to FIG. 2, the closure element (60) and an elastomer ring (71) sit on the rear end face (21) of the endpiece (20). The closure element (60) is, for example, a sealing film that has a thickness of 0.15 millimeter and is made from an aluminum alloy. The film material can also be comprised of polyethylene fibers as sold under the registered trademark Tyvek®, of the E. I. du Pont de Nemours and Company Corporation, 1007 Market Street Wilmington, Del. 19898, polyethylene (PE), polyethylene terephthalate (PET) or a composite material. The closure element or sealing film (60) is a round, flat and flexible disc. The elastomer ring (71) is made, for example, from silicone rubber, chlorinated rubber or butyl rubber. It is a closed ring with an at least approximately round individual cross section. It is flattened in the area via which it is adhesively bonded or scorched onto the sealing film (60). The sealing film (60) preferably has a material thickness of 50 to 300 micrometers.

The cap (81) is made up of two portions, namely a securing area (91) and a base area (95). The securing area (91) is a substantially cylindrical tube-shaped portion and includes undercut (92) for contacting flank (38) of catch elevation (37) and cylindrical outer contour (28). It engages around the endpiece (20) in the area of the catch elevation (37) provided on the latter. Its inner contour is shaped exactly in such a way that, after the cap (81) has been fitted in place, it sits free of play on the endpiece (20), at least in the area of the flank (38). The inner contour does not bear on the other flank (39), or it bears on the latter in some areas only.

The base area (95), which according to FIG. 2 rests partially with a flat base surface (96) on the sealing film (60), has a frustoconical outer contour (97) and a funnel-shaped central recess (98). The central recess (98), which corresponds to the through-hole (85), has a minimum diameter slightly smaller than the diameter of the rear opening (12) of the cylinder (11). The area of the recess (98) adjoining the base surface (96) is shaped cylindrically. The remaining area of the recess (98) widens rearwards in a funnel shape. This funnel shape facilitates the insertion of a plunger (not shown here) via which the piston (40) in the cylinder (11) is moved when the injector is triggered.

After the medicament chamber (10) has been filled and the piston (40) has been inserted, the sealing film (60), together with the elastomer ring (71), is fitted onto the end face (21) of the chamber (10). The elastomer ring (71) adhering to the sealing film (60) engages centrally around the radial flank (32) of the housing collar (31). When the cap (81) is fitted in place, it slides with its undercut (92) over the catch elevation (37). As soon as the undercut (92) bears on the front flank (38), the cap (81) has reached its end position. The base surface (96) then bears firmly on the sealing film (60). At the same time, the elastomer ring (71) in the area of the housing collar (31) sits sealingly between the cap (81) and the endpiece (20). In the axial direction, the elastomer ring (71) is forced in between the axial flank (34) and the sealing film (60) pressed firmly onto the base surface (96). The clamping force of the cap (81) is here generated, for example, by means of the annular clamping force of the securing area (91).

The housing collar (35) serves as an auxiliary abutment when the cap (81) is being fitted in place.

In small containers in particular, it is also conceivable for the cap to engage round the entire container. In this case, the cap then locks on the base of the container acting as catch element (37).

Figure 3:
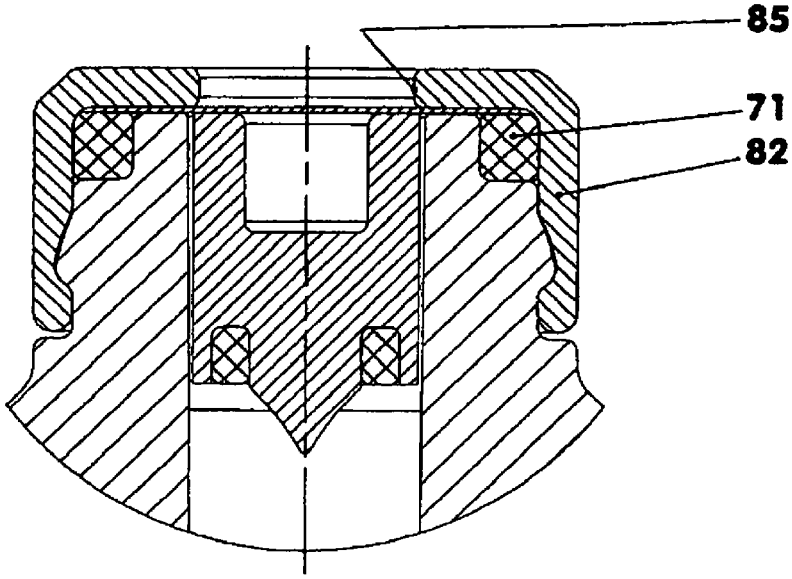
FIG. 3 shows the same view as in FIG. 2, but without the guide cone.

FIG. 3 shows a closure system with a simplified cap (82). This cap (82) does not have the insertion funnel (98).

Figure 4:
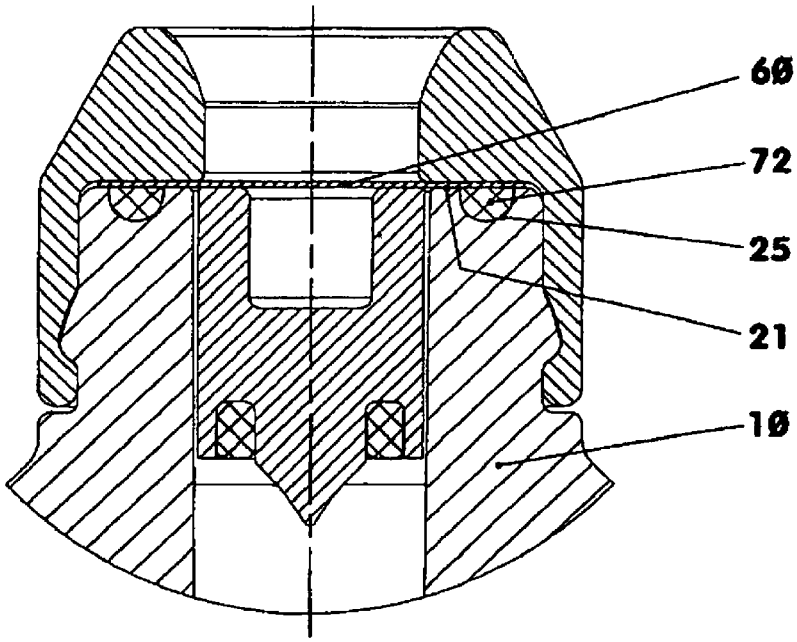
FIG. 4 shows the same view as in FIG. 2, but with a groove-like depression for receiving the elastomer ring.

A further variant of FIG. 2 is shown in FIG. 4. In this variant, a depression (25) in the form of an annular channel has been worked radially into the end face (21). The annular channel (25), whose individual cross section is composed of a rectangle surface and a semicircle surface, receives the elastomer ring (72) secured to the sealing film (60). Closed areas of the end face (21) are located to both sides of the annular channel (25). In these areas, the sealing film (60) bears firmly on the end face (21) of the chamber (10).

If appropriate, in this variant, an adhesive can be introduced into the annular channel (25) instead of an elastomer ring (72). This adhesive then bonds the applied sealing film (60) to the chamber (10).

Instead of a medicament chamber (10), it is also possible to use a glass vial (50) (see FIG. 5). In this case, a cap (83) engages round the neck (51) of the vial or container (50) with a form fit. The undercut (92) has an individual cross section in the shape of a barb.

In the vial (50), as also in the medicament chamber (10), the end face (21) can be designed sloping down towards the outside. Accordingly, the end face (21) describes a truncated cone for example, with a cone angle of 158±4 angular degrees for example. The imaginary cone tip lies outside the vial (50) or outside the medicament chamber (10).

FIG. 6 shows a closure system that does not require an elastomer ring. Instead, the cap (83) has; for example, two sealing lips (87, 88) that press the sealing film (60) elastically against the end face (21) of the medicament chamber (10) (see also FIG. 7). The first, outer sealing lip (87) is directed towards the atmosphere. It presses the sealing film (60) in the edge area of the opening (12) against the end face (21). In its individual cross section, the sealing lip (87) is inclined by approximately 45 angular degrees relative to the sealing film (60). Its wall thickness is greater here than that of the second, inner sealing lip (88).

The second, inner sealing lip (88) sits in a protected position under the first sealing lip (87). It presses the outer edge area of the sealing film (60) against the end face (21). It too is inclined by approximately 45 angular degrees relative to the sealing film (60). Both sealing lips (87, 88) are made of a permanently elastic material.

To ensure that the sealing film (60) can be placed at least more or less centrally on the end face (21) when assembling the closure system, this variant includes an abutment edge (22) whose height corresponds to at least twice the film thickness of the sealing film (60).

FIG. 7 shows an enlarged detail of FIG. 6. This enlargement shows that the sealing film (60), in the area of the edge of the opening (12), has a circumferential bead (62) in the form of a notch in the upper surface (61). The circumferential bead (62) represents a mechanical weakening of the sealing film (60). It is intended to make it easier to tear the film (60) off when administering the medicament.

FIG. 8 shows a variant of FIG. 6. The inner sealing lip (88) and the end face (21) here have another configuration. The end face (21) according to FIG. 8 has a channel (23) extending along the abutment edge (22). When the cap (84) is fitted in place, the sealing film (60) is pressed with the aid of the inner sealing lip (88) into this channel (23). The individual cross section of the sealing lip (88) is substantially angled, such that the front area (89) of the sealing lip (88) presses almost at right angles onto the sealing film (60). The rear area of the sealing lip (88) serves as a resilient zone.

When the cap (84) is fitted in place, the inner sealing lip (88) presses the sealing film (60) into the channel (23). In doing so, the sealing film (60) is made taut, such that it lies flat.

If appropriate, the front area (89) of the sealing lip (88) can also point outwards. In this case, the front area is part of a cone surface, the tip of which lies above the upper surface (61) of the sealing film (60) on the continued centre line of the chamber (10). Here, for example, the channel (23) can be omitted.

FIG. 9 shows a closure system which has an elevation (27), instead of a circumferential depression, on the end face (21) of the chamber (10) or vial (50). The elevation (27) lies at least approximately centrally in the annular surface of the end face (21). According to FIG. 9, the elevation (27) is formed, for example, by two truncated cone surfaces appearing as a triangle in individual cross section. The elevation can have almost any desired individual cross section. If appropriate, several elevations may also lie next to one another. Moreover, the individual elevation does not have to be arranged concentrically with respect to the centre line of the chamber (10). Nor does it have to be round in plan view.

The sealing film (60) bears on the end face (21) via the elastomer ring (73) that is arranged fixedly on it. The elastomer ring (73) has the shape of a perforated disc. In the compressed state in which it is installed, its material thickness is at least 30% greater than the height of the elevation (27). The elastomer ring (73) here reaches as far as the wall of the cylinder (11). In this variant, the clamping force of the cap (81) is determined by the elasticity of the elastomer ring (73).

Figure 11:
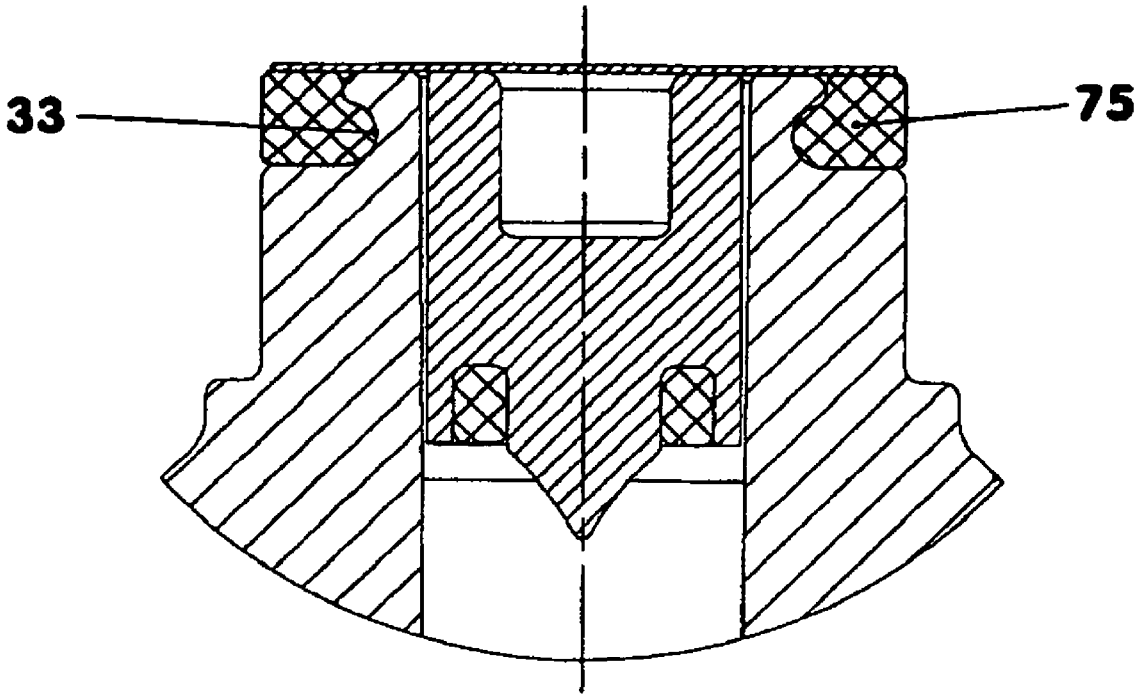

FIGS. 10 and 11 show a closure system variant without cap. This solution is based on a radial clamping force of the corresponding elastomer ring (74, 75). The elastomer ring (74, 75), which adheres to the underside of the elastic sealing film (60), has a smaller mean diameter in the state when not installed. Only upon assembly is it applied with elastic expansion onto the endpiece (20) and there, for example, onto the radial flank (32, 33).

The radial flank can in this case have a cylindrical contour (32) or a non-cylindrical contour (33). In FIG. 10, the contour (33) is shown by broken lines. Starting from the end face (21), its diameter decreases linearly downwards. Accordingly, the flank (33) has the form of a truncated cone surface whose theoretical tip lies, for example, in the central area of the chamber (10).

According to FIG. 10, the elastomer ring (74) is radially supported and clamped by a clamping ring (79). The clamping ring (79) bears both on the elastomer ring (74) and also on the outer contour (28) of the endpiece (20). It is only by way of example that it is shown here as being fixed via the catch elevation (37). The clamping ring (79) finishes flush with the sealing film (60) at the rear end of the chamber. If appropriate, the clamping ring (79) engages only around the elastomer ring (74).

FIG. 11 shows a closure system in which the assembly joint located between the contour (33) and the elastomer ring (75) forms an undercut. If appropriate, the elastomer ring (75), in the uninstalled state, already has a shape matching the contour (33). Here, for example, it is possible to dispense with a clamping ring.

Solutions are also possible in which the variants from FIGS. 1, 4, 6, 8 10 and 11 are superposed at least partially.

The sealing films (60) and if appropriate also the elastomer rings (71-73) can of course have self adhesive virus-proof coatings in the areas where they touch the end face (21) and the depressions (24, 25) or elevations (27).

What is claimed is:

1. A closure system for a container (10, 50) used for storing or administering substances in the form of liquids, pastes or powders, the container (10, 50) having an opening (12) that is to be closed, said closure system comprising a cap (81, 82) provided with a through-hole (85), the cap (81, 82) including a substantially cylindrical securing area (91), a flat, flexible closure element (60) for sealing the opening (12), the cap (81, 82) for holding the closure element (60) with a force fit and/or form fit on the container (10, 50) by means of the securing area (91) of the cap (81, 82) engaging a catch element (37) of the container (10, 50) in an area of the opening (12), the container (10, 50) includes an end face (21) which surrounds the opening (12), the end face (21) is in part in direct contacting relationship with the flat, flexible closure element (60), the end face (21) has a depression (24, 25) therein, the end face (21) in non-contacting relationship with the closure element (60) at depression (24, 25), the flat, flexible closure element (60) is virus-proof, bacteria-proof and spore-proof and is in part in direct contacting relationship with the end face (21) in the operative position and, the closure element (60) also lies in part over the depression (24, 25), and, an elastomer ring or adhesive ring (71, 72) is affixed to the flat, flexible closure element (60) in predetermined position prior to the flat, flexible closure element (60) placement on the end face (21) and the elastomer ring or adhesive ring (71, 72) in operative alignment with the depression (24, 25) and lying solely within and filling the depression (24, 25) in the operative position when the cap (81, 82) is fitted in place on the container (10, 50), the flat, flexible closure element (60) with the affixed elastomer ring or adhesive ring (71, 72) for providing a hermetic seal of the container (10, 50) as desired.

2. The closure system according to claim 1, wherein the flat, flexible closure element (60) is disc-shaped.

3. The closure system according to claim 2, wherein the flat, flexible closure element (60) has a material thickness of 50 to 300 micrometers.

4. The closure system according to claim 2, wherein the flat, flexible closure element (60) comprises an aluminium alloy or polyethylene.

5. The closure system according to claim 2, wherein in the area of the opening (12) of the container (10, 50), the flat, flexible closure element (60) has, in its upper surface (61), a bead (62) in the form of a notch that weakens the closure element (60).

6. The closure system according to claim 1, wherein the depression (24) lies at the outer edge of the end face (21) with the elastomer ring or adhesive ring (71, 72) lying solely in the depression in the operative position.

7. The closure system according to claim 1, wherein the depression (25) is in the form of an annular channel worked radially into the end face (21) a predetermined distance from the outer edge and the inner edge of the end face (21), the end face (21) forming contact areas in direct contacting relationship on both sides of the depression (25) with the flat, flexible closure element (60), the elastomer ring or adhesive ring (71, 72) lying solely in the depression (25) in the operative position.

* * * * *